United States Patent [19]

Nowacki

[11] 4,226,091

[45] Oct. 7, 1980

[54] HEAT PUMP CONTAINING A PISTON COMPRESSOR AND DRIVEN BY A PISTON ENGINE

[75] Inventor: Jan-Erik A. Nowacki, Hölö, Sweden

[73] Assignee: Studsvik Energiteknik AB, Nykoping, Sweden

[21] Appl. No.: 30,892

[22] Filed: Apr. 17, 1979

[30] Foreign Application Priority Data

Apr. 26, 1978 [SE] Sweden ..... 7804805

[51] Int. Cl.[3] ..... F25B 27/00; F25B 27/02; F25B 13/00

[52] U.S. Cl. ..... 62/323; 62/238; 62/324

[58] Field of Search ..... 62/323 R, 238 E, 324 D; 417/358; 123/41.19; 60/DIG. 5

[56] References Cited

U.S. PATENT DOCUMENTS

| | | | |
|---|---|---|---|
| 3,359,749 | 12/1967 | Howland et al. | 62/323 R |
| 3,483,854 | 12/1969 | Foran et al. | 62/323 R |
| 3,721,104 | 3/1973 | Adler | 62/323 C |
| 3,788,394 | 1/1974 | Derragon, Jr. | 62/323 R |
| 4,055,299 | 10/1977 | Norberg et al. | 62/238 E |

*Primary Examiner*—Lloyd L. King

*Attorney, Agent, or Firm*—Burns, Doane, Swecker & Mathis

[57] ABSTRACT

A heat pump contains a piston compressor which is driven by a piston engine. The refrigerant on the low pressure side of the heat pump drives the engine during the compression stroke of the engine. An accumulator chamber for the low pressure refrigerant is provided adjacent the compressor. The volume of the accumulator chamber is so large that the compressor piston, and consequently also the engine piston, is given a speed high enough for producing the required compression in the engine cylinder.

15 Claims, 8 Drawing Figures

A-A

HEAT PUMP CONTAINING A PISTON COMPRESSOR AND DRIVEN BY A PISTON ENGINE

The invention relates to a heat pump with a piston compressor driven by a piston engine, preferably an internal combustion engine. By "internal combustion engine" is intended here every type of piston internal combustion engine, e.g. one in which the fuel-air mixture is ignited by a spark, or one in which the fuel is ignited by the high temperature generated by the combustion air compression.

The heat pump in accordance with the invention may be of the known type in which the pistons of the engine and the compressor are interconnected via a rotary member such as a crankshaft or a flywheel. Preferably, the heat pump is of the known type, in which the pistons of the engine and compressor are united to form a freely movable double piston. A disadvantage with such a freely movable double piston is that its position is not fixed during periods of inactivity. In starting the engine, the double piston must be put into movement such as to start combustion in the engine cylinder. Compressed air has been used to start the engine, for example. The engine has to be a two-stroke engine, since the heat pump piston compressor works with a two-stroke cycle. The object of the present invention is generally to provide an internal combustion engine-driven heat pump which can be manufactured at a low price, and which is suitable for use in heating small houses. A special object of the invention is to provide a combined engine and heat pump in which the engine can be made to start solely with the aid of the pressure in the refrigerant on the low pressure side of the heat pump. Another particular object of the invention is to provide a combined engine and heat pump in which the speed of the engine can be varied within wide limits. Other objects will be apparent from the description.

The heat pump in accordance with the invention comprises a piston compressor driven by a piston engine, in which the cylinder of the compressor communicates with the condensor of the heat pump via a high pressure refrigerant conduit, and communicates with the evaporator of the heat pump via a low pressure refrigerant conduit, and is characterized in that an accumulator chamber for low pressure refrigerant is provided in the low pressure refrigerant conduit adjacent the cylinder of the compressor, the low pressure refrigerant in said accumulator chamber driving the compressor piston and the engine piston during the compression stroke of the engine, the volume of said accumulator chamber being of such magnitude that the compressor piston and the engine piston are given a sufficiently high speed to produce the compression in the engine cylinder.

The ratio between the areas of the compressor piston and the engine piston is preferably 1.25–1.50. The volume of the accumulator chamber is preferably at least 2.5 times the stroke volume of the compressor piston. The low pressure refrigerant shall flow from the accumulator chamber to the compressor cylinder with a low flow resistance. Therefore, the accumulator chamber communicates with the compressor cylinder through an opening having an area which is at least 7 percent of the area of the piston of the compressor. In this way it has been found possible to achieve a compression which is even sufficient for a diesel engine.

During periods of inaction it is preferred that the piston of the compressor is retained in a position close to the top of the compressor cylinder. For starting the engine it is enough to release the piston of the compressor. The pressure in the compressor cylinder, i.e. on the low pressure side of the heat pump, drives the compressor piston, and consequently also the engine piston, in the direction producing a compression of the air (or air-fuel mixture) in the cylinder of the engine, resulting in the engine starting. Magnetic means may be used for retaining the piston of the compressor. In a heat pump of the free-piston type an electromagnet can be arranged to attract the engine piston of the double piston in the desired inactive position. Alternatively, the retaining means can be made to retain the double piston mechanically in the inactive position, e.g. with the help of a locking pin engaging a stop on the double piston. The locking pin can be controlled by a solenoid. We prefer, irrespective of what type of retaining means is selected, to allow it to engage the middle portion of the double piston, i.e. with the piston rod uniting the engine piston and the compressor piston. This piston rod can move in a space open to the atmosphere, and there are therefore no difficulties in allowing the retaining means to engage the piston rod. That said space is open to the atmosphere also has the advantage that leaking combustion gas cannot come into the compressor, and that leaking refrigerant from the compressor cannot come into the engine. In a heat pump in which the pistons of the engine and the compressor are interconnected by means of a rotary member, such as a crankshaft or a flywheel, the means for retaining the compressor piston may be arranged to coact with said rotary member.

The refrigerant in the heat pump may be a conventional refrigerant, such as R22 ($CHClF_2$), R 290 (propane), R 502 (an azeotropic mixture of $CHClF_2$ and $ClF_2CF_3$), or R 717 (ammonia).

The invention will now be described with reference to the drawings.

Figure 1:
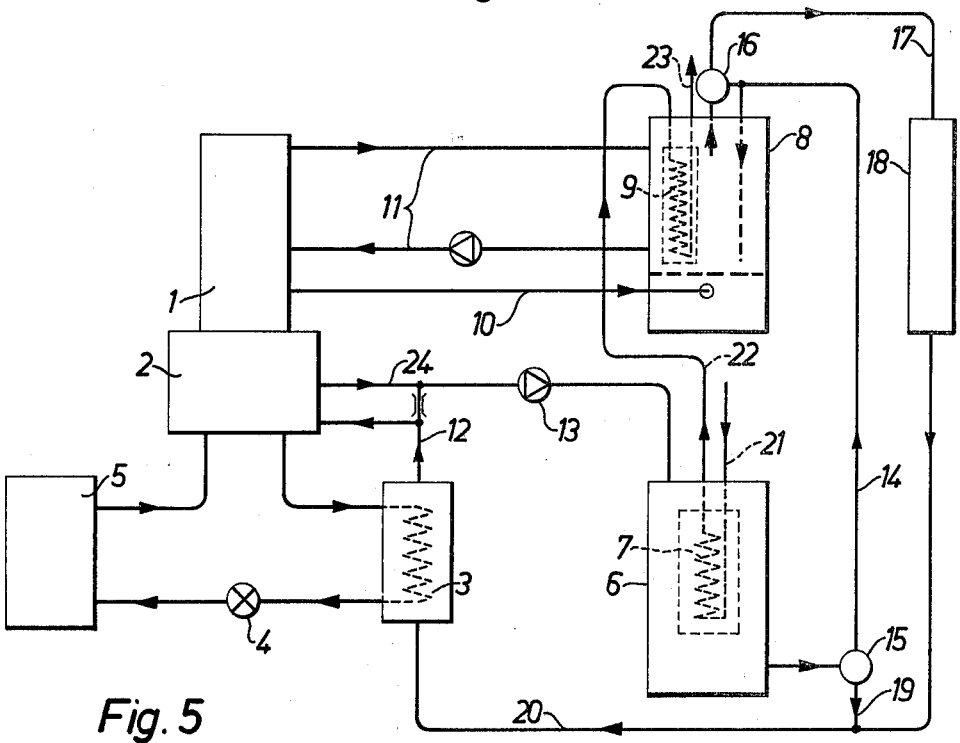
FIG. 1 illustrates the use of the heat pump in an installation for heating a house.

The installation according to FIG. 1 contains a heat pump in accordance with the invention, comprising an engine 1, a compressor 2, a condenser 3, an expansion valve 4 and an evaporator 5. The evaporator can be arranged for taking up heat from the outside air, for example. The installation further contains two hot water reservoirs, namely a low temperature reservoir 6 containing a heat exchanger 7 and a high temperature reservoir 8 containing a heat exchanger 9, in the house which is to be heated. The exhaust gases from the engine 1 are taken via a conduit 10 to the high temperature reservoir 8 for heating the water therein. The cooling system of the engine is in communication with the high temperature reservoir via conduits 11. The compressor is in communication via a conduit 24 with a circulation pump 13 leading to the low temperature reservoir 6 and with a conduit 12 from the condenser 3. The reservoirs 6 and 8 are in communication with each other via a conduit 14 containing a three-way valve 15 and a shunt valve 16. Via a conduit 17 the latter is in communication with the radiators 18 of the house, said radiators being in communication with the condenser 3 via a conduit 20. The heat exchanger 7 is connected to a cold water intake 21 for consumption water, and via a conduit 22 to the heat exchanger 9, which is connected to a conduit 23 for taking off hot consumption water.

The installation functions in the following way. The hot water received in the radiators 18 via the conduits 17 has been heated in three steps, first in the heat pump condenser 3, second by the compressor cooling water and finally by the engine exhaust gases and cooling water in the high temperature reservoir 8. The water flow past the high temperature reservoir 8 can be regulated with the aid of the shunt valve 16 in a manner known per se, and thus, if so desired, the heating of the radiator water in the high temperature reservoir can be completely dispensed with. If it is not desired to heat the radiators at all, the entire flow of water is caused to pass from the conduit 14 to the conduit 20 via a conduit 19 with the help of the three-way valve. In the illustrated installation, the heat content in the fuel consumed by the engine 1 has been effectively recovered by utilizing the heat in the cooling water as well as in the exhaust gases. An extra heat increment has also been obtained by using the heat pump to take up heat in the vaporizor 5 and to emit this heat in the condenser 3.

Figure 2:
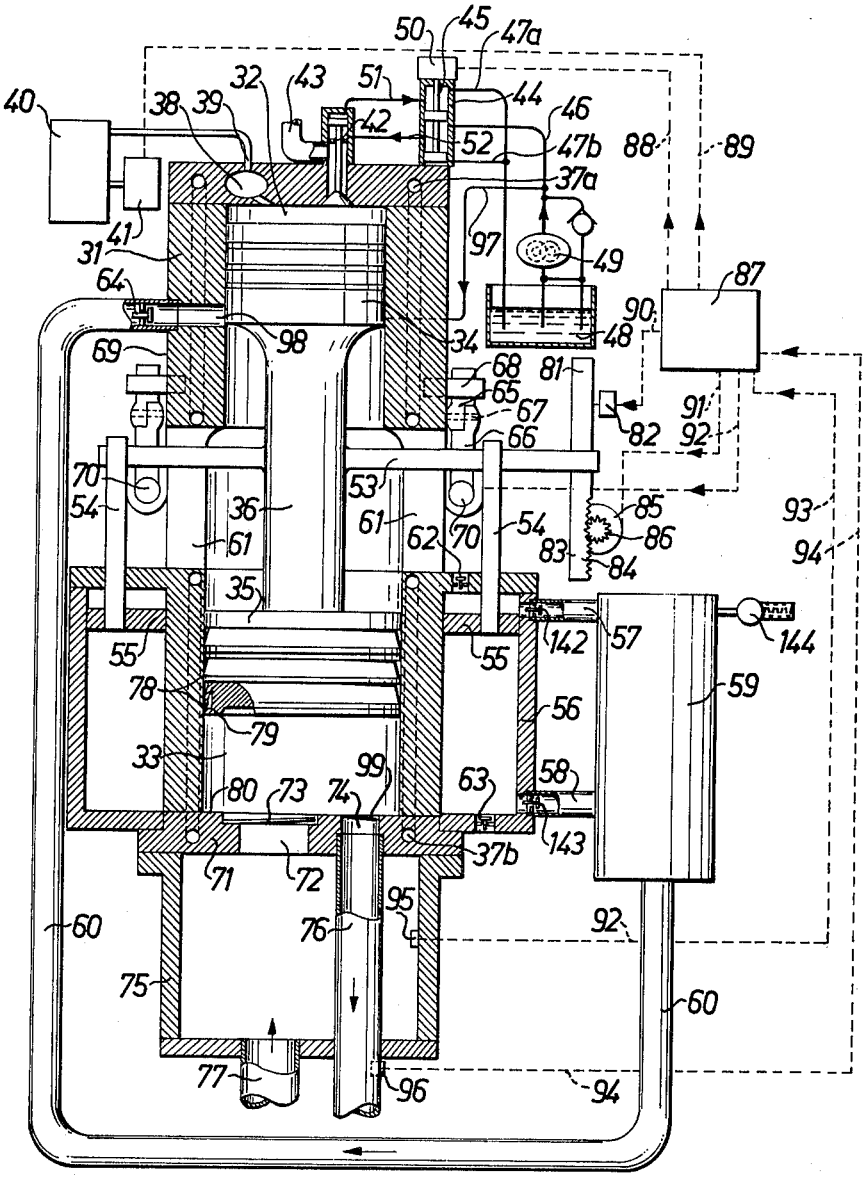
FIG. 2 shows a heat pump of the free-piston type in accordance with the invention.
Figure 3:
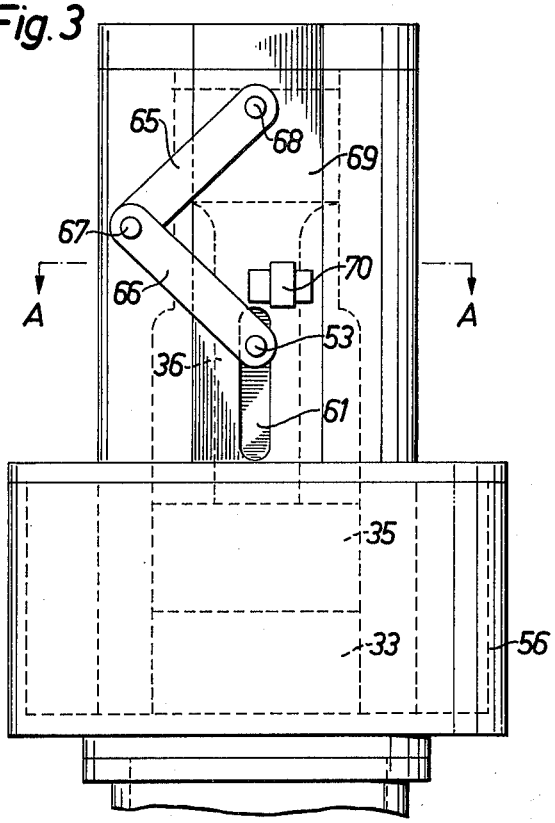
FIG. 3 shows the retaining means for the double piston in the heat pump according to FIG. 2.
Figure 4:
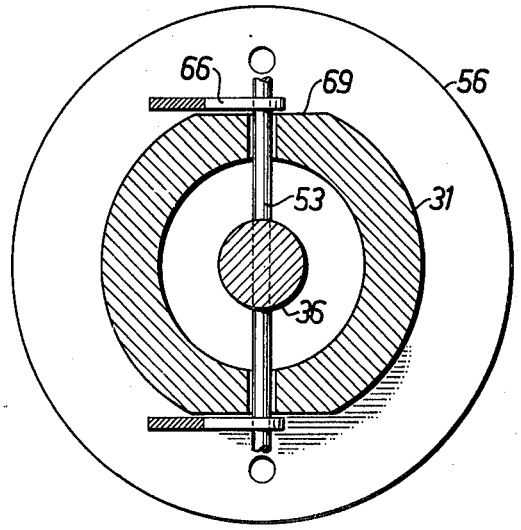
FIG. 4 is a section along the line A—A in FIG. 3.

The engine-driven compressor in FIGS. 2–4 contains a cylinder 31, the upper portion 32 of which forms an engine cylinder containing an engine piston 34, and the lower portion 33 of which forms a compressor cylinder containing a compressor piston 35. The pistons 34 and 35 are united by a rod 36 to form a double piston. Two separate ducting systems 37*a* and 37*b* are formed in the cylinder wall for cooling water. In the side wall of the motor cylinder there is arranged an air intake port 98. In the top wall of the engine cylinder there is arranged an antechamber 38 in which fuel is injected by means of a nozzle 39 fed from a fuel pump 40 driven by an electric motor 41. There is also arranged in the top wall of the engine cylinder an exhaust gas valve 42 controlling the exhaust gas flow to an exhaust pipe 43. The exhaust valve is controlled hydraulicly via a hydraulic valve, the piston 45 of which is caused by an electromagnet 50 to assume an upper and a lower position, and thereby put a hydraulic pipe 46 in communication with one of the pipes 51 or 52 to the exhaust valve. Returning hydraulic oil is taken via a pipe 47*a* or 47*b* to an oil reservoir 48. A cogwheel pump 49 generates the necessary hydraulic pressure. The hydraulic oil also lubricates the engine via a pipe 97.

A shaft 53 is attached to the piston rod 36, said shaft extending perpendicular to the rod 36 out through elongate apertures 61 in the cylinder 31. Piston rods 54 are attached to the shaft 53, said rods each being united to an annular piston 55 in an annular cylinder 56 for combustion air and scavenging air. The cylinder 56 has two air intake ports 62, 63, provided with valves, and two pipes 57, 58 provided with valves 142, 143 and leading to an air accumulator 59 having a safety valve 144. The air is taken via a pipe 60 with a non-return valve 64 to the air intake port 98 of the engine cylinder.

A pair of links is arranged on either side of the cylinder 31 for retaining the double piston 34-36, there being an upper link 65 and a lower link 66 in each pair. The links in each pair are pivotally connected by means of a journalling pin 67. By means of a shaft 68, the upper link 65 is attached to a flat portion 69 on the outer wall of the cylinder 31. The lower link 66 is pivotably attached to said shaft 53. The lengths of the links 65, 66 are selected such that the links are completely extended, i.e. parallel to each other and to the longitudinal axis of the double piston, when the double piston 34-36 is in its bottommost position. A pulling electromagnet 70 is arranged adjacent each pair of links, or more exactly at the point where the pin 67 is when the double piston 34-36 is at its bottommost position. If the electromagnets 70 are energized with the double piston in this position, the links are attracted by the magnets, and the double piston is retained in its bottommost position as long as the electromagnets are energized.

In the machine shown, the compressor part comprises the previously mentioned compressor cylinder 33. In the top wall 71 of this cylinder, there is arranged an inlet port 72 provided with a non-return valve 73, for the low pressure refrigerant, and an outlet port 74 provided with a non-return valve 99 for the compressed refrigerant. The outlet port 74 is in communication with the heat pump condenser via a pipe 76. The inlet port 72 is in communication with a chamber 75, functioning as accumulator chamber for the low pressure refrigerant. This chamber 75 is in communication with the heat pump vaporizor via a pipe 77. The chamber 75 is also utilized for separating liquid from the gaseous low pressure refrigerant.

The compressor piston 35 is provided with a plurality of sealing members 78 round its circumference for sealing against the cylinder wall. To increase the sealing effect when not in action, the end surface of the compressor piston has been provided with a projecting bead 79 along its circumference. In the bottommost position of the compressor piston, the bead 79 abuts with a certain pressure against a seating 80 on the top wall 71. It has been found suitable to make the compressor piston from polytetrafluoroethylene. If refrigerant should leak out between the compressor piston and the wall of the compressor cylinder, this refrigerant then flows out to the surrounding atmosphere through the apertures 61 in the cylinder 31, and thus cannot come into the engine cylinder. In a corresponding manner, possible exhaust gas leaking out from the engine cylinder goes out through the apertures 61 and thus cannot come into the compressor.

The shaft 53 is at one end provided with two rods 81 and 83, extending parallel to the longitudinal axis of the double piston. The rod 81 coacts with a positional indicator 82, sensing the position assumed by the double piston 34-36. The rod 83 is provided with a rack 84. Adjacent the rack there is arranged an electric motor 85 with a Bendix drive and a gear wheel 86 for coaction with the rack 84. With the aid of the motor 85, the double piston 34-36 can be taken down to its bottommost end position in case the engine start is unsuccessful. The motor 84 thus functions as an auxiliary start motor.

The illustrated machine is controlled by a microprocessor 87, known per se, containing amplifiers etc. By means of a wire 88, the microprocessor 87 is connected to the electromagnets 50 of the hydraulic valve 45, by a wire 89 to the fuel pump electric motor 41, by a wire 90 to the positional indicator 82, by a wire 91 to the auxiliary starting motor 85, by a wire 92 to a pressure transducer 95 in the accumulator chamber 75, by a wire 93 to the electromagnet 70, and by a wire 94 to a pressure transducer 96 in the pipe 76 on the high pressure side of the refrigerant. The operational mode of the microprocessor will be explained below in connection with an explanation of the mode of operation of the machine.

In the position shown in FIG. 2, the double piston 34-36 is in its uppermost position, i.e. combustion air has been compressed to the ignition temperature of the fuel, and the combustion stroke is just about to start. The positional indicator 82 now gives a signal to the microprocessor, which starts the electric motor 41, the fuel pump 40 pumping fuel to the nozzle 39, which sprays finely divided fuel into the antechamber 38 and engine cylinder 32. The fuel is spontaneously ignited due to the high temperature, and drives the double piston 34-36 downwards, the compressor piston 35 thus compressing the refrigerant in the compressor cylinder 33, and the air pump 55, 56 pumps in air into the accumulator 59. When sufficient fuel has been injected to give the piston 34 the necessary kinetic energy downwards to compress the refrigerant, the microprocessor, on receiving a signal from the positional indicator 82, stops the fuel pump electric motor 41, fuel injection to the motor thus ceasing. When the piston has nearly reached bottom position, the microprocessor energizes the electromagnet 50 so that the hydraulic valve 45 is taken over to its other end position, thus opening the exhaust valve 42. The combustion gases then leave the engine cylinder 32, scavenging air and new combustion air then being blown into the cylinder from the chamber 59 via the pipe 60 and the air intake port 98. The movement of the double piston 34, 36 has now stopped, with the sealing bead 79 of the compressor piston very close to the seating 80. If the pressure transducer 96 gives a signal at this instant to the microprocessor that the pressure of the refrigerant in the pipe 76 is greater than a predetermined value, the microprocessor energizes the electromagnets 70, which attract the links 65, 66, resulting in that the links press the double piston downwards a very short distance, namely sufficiently far for the bead 79 to come into contact with and be pressed against the seating 80. The machine will remain in this position until the pressure in the accumulator chamber 75 has dropped to below a predetermined value. The pressure transducer 95 then gives a signal to the microprocessor, which closes the exhaust valve 42 and deenergizes the electromagnets 70. When the links 65, 66 are thus released, the pressure of the refrigerant in the accumulator chamber 75 will drive the double piston 34-36 upwards while compressing the combustion air in the engine cylinder 32. The volume of the accumulator chamber 75 should be sufficiently large for the double piston to obtain kinetic energy large enough for the last part of the compression work to be carried out by this energy. The volume of the accumulator chamber is preferably at least 2.5 times the stroke volume of the compressor piston. The port 72 between the accumulator chamber 75 and the compressor cylinder 33 should be large enough for the refrigerant to flow quickly into the cylinder without notable pressure loss. The area of the opening 72 is preferably at least 7 percent of the area of the compressor piston 35.

The described cycle is repeated after compression of the combustion air is terminated.

If the heat pump is to be driven at maximum power, the engine is allowed to work continuously, i.e. the movement of the double piston is allowed to continue without being stopped by the retaining means. The double piston then adjusts itself to a frequency substantially determined by its mass and by the pressure in the engine cylinder and compressor cylinder. If the heat pump is to be operated at lower power, the movement of the double piston is arrested during suitable periods of time with the aid of the retaining means. For very low power, the double piston is only allowed to execute one stroke at a time.

Figure 5:
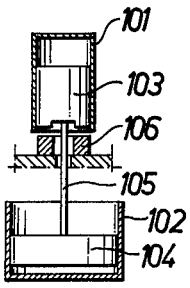
FIGS. 5 and 6 show two alternative retaining means for the double piston.

FIG. 5 illustrates how the double piston can be retained by means of an electromagnet acting directly on the engine piston, which must then be made from magnetic material. Very schematically, the Figure shows an engine cylinder 101, a compressor cylinder 102 and a double piston consisting of an engine piston 103, a compressor piston 104 and a rod 105 connecting said pistons. An annular electromagnet 106 is arranged coaxially with the rod 105 in a position corresponding to the bottommost position of the engine piston 103. If the electromagnet is energized when the piston 103 is in this bottommost position, the electromagnet will retain the double piston in this position as long as the electromagnet is energized.

Figure 6:
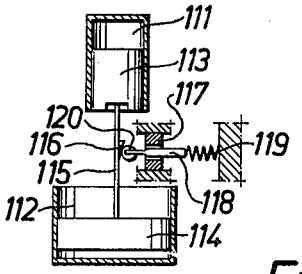

FIG. 6 illustrates how the double piston can be retained by mechanical action on the rod connecting the engine and compressor pistons. Very schematically, the figure shows an engine cylinder 111, a compressor cylinder 112 and a double piston consisting of an engine piston 113, a compression piston 114 with a rod 115 uniting them. The rod 115 is provided with a locking member 116 having one surface forming a small angle to the rod and a surface at right angles to the rod. A locking pin 118 is biassed by a compression spring 119 towards the rod 115. The locking pin is provided with a wheel 120 rolling on the sloping surface of the locking member for the downward movement of the double piston, and when the double piston has reached its bottommost position, said wheel snaps in over the locking member on the perpendicular surface towards the rod 115, and thus locks the double piston in this position. To release the double piston, an annular electromagnet 117 is arranged around said pin 118 which is made from magnetic material. When the electromagnet is energized, it pulls the pin with wheel 120 from engagement against the locking member 116. Alternatively, the spring 119 can be formed as a tension spring biassing the pin with wheel 120 away from the rod 115. The electromagnet 117 is then arranged to move the locking pin with wheel 120 into engagement with the locking member 116, on being energized.

Figure 7:
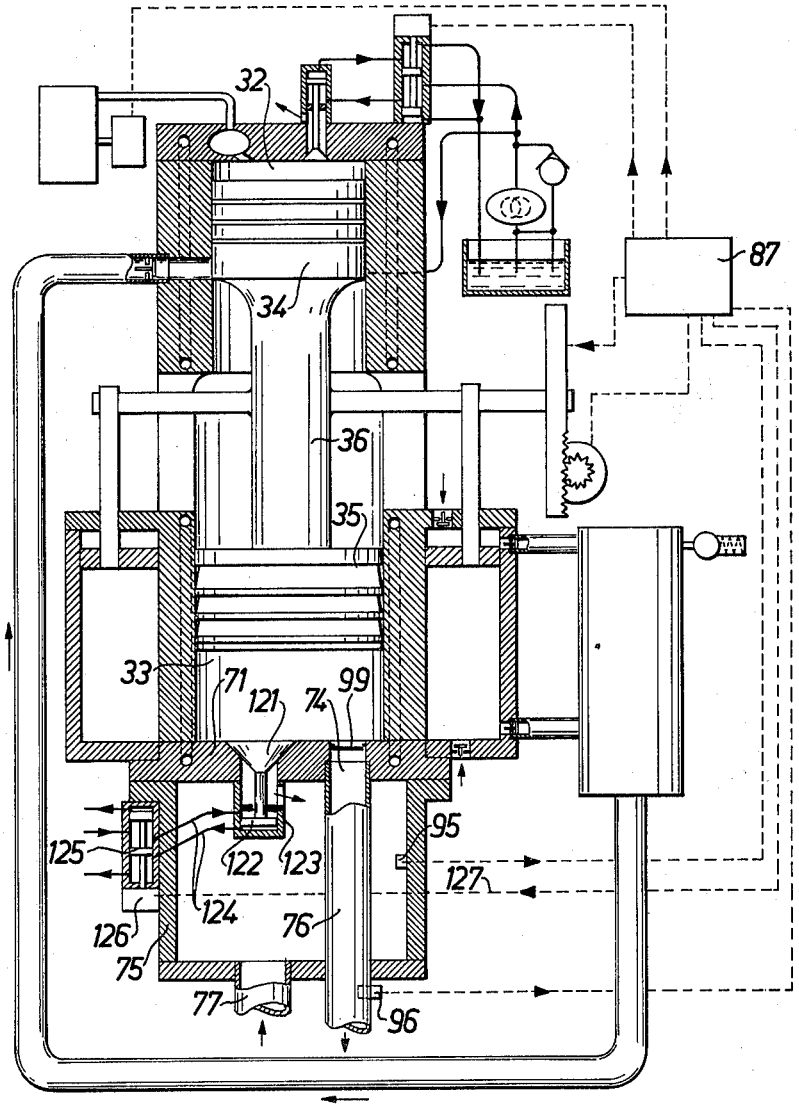
FIG. 7 shows another heat-pump of the free-piston type

The apparatus illustrated in FIG. 7 is to a large extent like the apparatus in FIG. 2, and the same reference characters have been used for corresponding parts. The links 65, 66 for retaining the double piston according to FIG. 2 are lacking in FIG. 7, and so is the nonreturn valve 17 formed as a flat spring in FIG. 2. Instead, a hydraulically controlled valve 121 is arranged in the top wall 71 of the compressor cylinder 33, said valve being provided with a piston 122, movable in a cylinder 123. Via pipes 124, the cylinder 123 is in communication with a hydraulic valve 125, of the same kind as the hydraulic valves 44, 45 in FIG. 2. The valve piston 125 is controlled by an electromagnet 126 which is in communication with the microprocessor 87 via a wire 127.

When compressor piston 35 moves downwards during the combustion stroke of the engine, the valve 121 is kept closed. The refrigerant compressed in the cylinder 33 leaves the cylinder via the pipe 76. By carefully adjusting the quantity of fuel injected into the engine cylinder 32, it is possible to get the compressor piston 35 to stop closely adjacent the cylinder top 71. Getting the double piston 34-36 to remain in this position is facilitated if said piston is made heavy, and if the machine is mounted in the position shown, i.e. with the double piston vertical and the compressor cylinder 33 downmost, and the engine cylinder 32 on top. As long as the double piston 34-36 is to be inactive, the valve 121 is kept closed. When the heat pump is to start, the electromagnet 126 is energized by the microprocessor 87, and switches over the hydraulic valve 125, thus opening the valve 121, and the refrigerant in the accumulator chamber 75 drives the double piston 34-36 upwards, as has been described in conjunction with FIG. 2.

Figure 8:
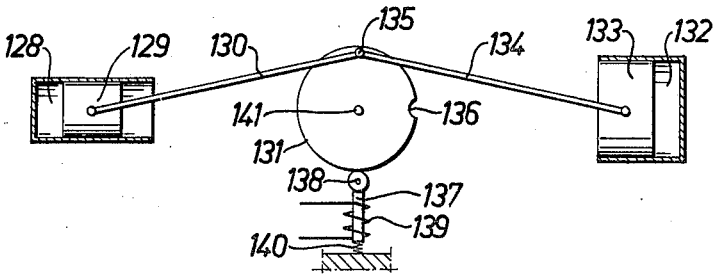
FIG. 8 illustrates a piston retaining means in a heat pump in which the pistons of the engine and the compressor are interconnected by means of a flywheel.

FIG. 8 illustrates in a simplified way a machine of the invention with a rotary motion. The engine contains a cylinder 128 and a piston 129 with a piston rod 130. The compressor contains a cylinder 132 and a piston 133 with a piston rod 134. Both piston rods are fastened to a rotary shaft 135 near the periphery of a flywheel 131 rotating on a shaft 141. Therefore, the movements of the pistons 129, 133 will be on phase, so that the combustion stroke of the engine corresponds to the compression stroke of the compressor. A locking pin 137 having a wheel 138 on one end is biassed by a compression spring 140 towards the flywheel 131. An annular electromagnet 139 pulls, when energized, the locking pin 137 from the flywheel 131. The electromagnet is preferably energized by means of a microprocessor of the kind described in connection with FIG. 2.

The periphery of the flywheel 131 has a recess 136 to engage the wheel 138 on the locking pin 137 immediately after the compressor piston 133 has passed the lower limit of its stroke. The compression spring 140 now retains the wheel 138 in the recess 136. Consequently, the pistons and the flywheel are in a locked position. For starting the machine the electromagnet 139 is energized, the locking pin 137 is pulled back, the wheel 138 releases the flywheel 131, and the refrigerator on the low pressure side of the heat pump sets the compressor piston 133 in motion. The wheel 131 has been referred to as a flywheel. In fact, said wheel rather has the function of a crankshaft, because there is no particular need for the wheel to have a high weight.

I claim:

1. A heat pump containing a piston compressor driven by a piston engine, in which the cylinder (33) of the compressor communicates with the condensor of the heat pump via a high pressure refrigerant conduit (76), and communicates with the evaporator of the heat pump via a low pressure refrigerant conduit (77), characterized in that an accumulator chamber (75) for low pressure refrigerant is provided in the low pressure refrigerant conduit (77) adjacent the cylinder (33) of the compressor, the low pressure refrigerant in said accumulator chamber (75) driving the compressor piston (35) and the engine piston (34) during the compression stroke of the engine, the volume of said accumulator chamber (75) being of such magnitude that the compressor piston (35) and the engine piston (34) are given a sufficiently high speed to produce the compression in the engine cylinder (32).

2. A heat pump as claimed in claim 1, characterized in that the pistons (34, 35) of the engine and of the compressor are combined to form a double, free piston (34-36).

3. A heat pump as claimed in claim 2, characterized by means (65, 66) for retaining, during periods of inaction, the double piston (34-36) in such a position that the compressor piston (35) is close to the top (71) of the compressor cylinder (33).

4. A heat pump as claimed in claim 2, characterized by a sealing bead (79) on the end surface of the compressor piston, arranged to be kept sealingly pressed against a seating (80) on the top of the compressor cylinder during periods of inaction.

5. A heat pump as claimed in claim 2, characterized in that the means for retaining the double piston (34-36) consists of at least one pair of links (65, 66) pivotably attached to a stationary portion of the heat pump and to the double piston (34-36), the length of the links (65, 66) being such that said links are substantially parallel to the longitudinal direction of the double piston when the compressor piston is close to the top (71) of the compressor cylinder (33), and that an electromagnet (70) is arranged to attract the links when the compressor piston is in said position.

6. A heat pump as claimed in claim 2, characterized in that the means for retaining the double piston (34-36) consists of an electromagnet (106) arranged to attract the engine piston (103), which is made from magnetic material, when the compressor piston (35) is close to the top (71) of the compressor cylinder (33).

7. A heat pump as claimed in claim 2, characterized in that the means for retaining the double piston (34-36) comprises a locking member (116) on the double piston, preferably on a rod (115) connecting the engine piston (113) with the compressor piston (114), a locking pin (118) coacting with the locking member, and means (119) for bringing the locking pin into engagement with the locking member when the compressor piston is close to the top (71) of the compressor cylinder (33).

8. A heat pump as claimed in claim 1, characterized in that an externally controlled valve (121) is arranged between the compressor cylinder (33) and the accumulator chamber (75), and control members (87, 122-126) for keeping said valve closed during the combustion stroke of the engine and open during the compression stroke of the engine.

9. A heat pump as claimed in claim 8, characterized in that the control members are arranged to control the amount of fuel supplied to the engine so that the double piston (34-36) stops, after the combustion stroke of the engine, in such a position that the compressor piston (35) is close to the top of the compressor cylinder (33).

10. A heat pump as claimed in claim 9, characterized in that the control members are also arranged to control an exhaust gas valve (42) in the engine cylinder.

11. A heat pump as claimed in claim 1, characterized in that the pistons (129, 133) of the engine and the compressor are interconnected by means of a crankshaft (131).

12. A heat pump as claimed in claim 1, characterized in that the ratio between the areas of the compressor piston (35) and the engine piston (34) is 1.25–1.50.

13. A heat pump as claimed in claim 1, characterized in that the volume of the accumulator chamber (75) is at least 2.5 times the stroke volume of the compressor piston.

14. A heat pump as claimed in claim 1, characterized in that the accumulator chamber (75) communicates with the cylinder (33) of the compressor through an opening (72) having an area which is at least 7 percent of that of the piston (35) of the compressor.

15. A heat pump as claimed in claim 1, characterized in that the refrigerator is R22, R290, R502 or R717.

* * * * *